US006228566B1

(12) United States Patent
Goddard et al.

(10) Patent No.: US 6,228,566 B1
(45) Date of Patent: May 8, 2001

(54) HIGH CONTRAST PHOTOGRAPHIC ELEMENT CONTAINING A NOVEL NUCLEATOR

(75) Inventors: John D. Goddard, Pinner; Philip J. Coldrick, Twickenham; Rebecca Glen, St Anne's-on-Sea; Dawn J. Jenkins, Chesham, all of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/618,357

(22) Filed: Jul. 18, 2000

Related U.S. Application Data

(62) Division of application No. 09/444,777, filed on Nov. 22, 1999, now Pat. No. 6,143,462.

(30) Foreign Application Priority Data

Dec. 8, 1998 (GB) ..... 9826870

(51) Int. Cl.[7] ..... G03C 5/29
(52) U.S. Cl. ..... 430/434; 430/265
(58) Field of Search ..... 430/265, 434

(56) References Cited

U.S. PATENT DOCUMENTS

| | | | |
|---|---|---|---|
| 4,030,925 | 6/1977 | Leone et al. | 430/217 |
| 4,031,127 | 6/1977 | Leone et al. | 558/412 |
| 4,269,929 | 5/1981 | Nothnagle et al. | 430/264 |
| 4,278,748 | 7/1981 | Sidhu et al. | 430/212 |
| 4,323,643 | 4/1982 | Mifune et al. | 430/441 |
| 4,668,605 | 5/1987 | Okutsu et al. | 430/267 |
| 4,740,452 | 4/1988 | Okutsu et al. | 430/439 |
| 5,288,590 | 2/1994 | Kuwabara et al. | 430/264 |
| 5,316,889 | 5/1994 | Sakai et al. | 430/264 |
| 5,695,909 | 12/1997 | Oya et al. | 430/264 |

FOREIGN PATENT DOCUMENTS

| | | |
|---|---|---|
| 0 333 435 | 8/1981 | (EP) . |
| 0 364 166 | 4/1990 | (EP) . |
| 0 598 315 | 5/1994 | (EP) . |
| 95/32453 | 11/1995 | (WO) . |

*Primary Examiner*—Hoa Van Le
(74) *Attorney, Agent, or Firm*—Edith A. Rice

(57) ABSTRACT

The invention relates to an ultrahigh contrast photographic material comprising a support bearing a silver halide emulsion layer, containing a hydrazide nucleating agent in the emulsion layer or a hydrophilic colloid layer, characterized in that the nucleating agent is a dimeric molecule comprising two monomers linked by a linking group, each monomer of which (a) may be the same or different and (b) comprises an acylhydrazide moiety and a nicotinamide moiety in combination, the material providing unexpectedly good nucleation in the absence of, or with reduced amounts of, booster and in a developer whose pH is variable, and further with lower chemical spread and pepper fog.

6 Claims, No Drawings

HIGH CONTRAST PHOTOGRAPHIC ELEMENT CONTAINING A NOVEL NUCLEATOR

This a Divisional of application Ser. No. 09/444,777, filed Nov. 22, 1999, now U.S. Pat. No. 6,143,462.

FIELD OF THE INVENTION

This invention relates to high contrast photographic silver halide materials and in particular to those of the graphic arts type.

BACKGROUND OF THE INVENTION

In the field of graphic arts, an ultrahigh contrast photographic material is required for achieving satisfactory halftone dot reproduction of a continuous tone or reproduction of a line image in the process of making a lithographic printing plate. For many years these ultrahigh contrast photographic images were obtained by developing a 'lith' emulsion (usually high in silver chloride content) in a hydroquinone, low sulphite, 'lith' developer by the process known as infectious development. However, such low sulphite developers are inherently unstable and are particularly inappropriate for machine processing.

More recently an image formation system providing ultrahigh contrast where the gamma (contrast) exceeds 10 has been provided conventionally in a material wherein silver halide bearing a surface latent image is developed in the presence of a specific acylhydrazine (also known as a nucleating agent) which can be incorporated into the photographic material or into the developer. The pH of the developer solution is usually in the range 10.0 to 12.3, typically about 11.5, and the developer includes conventional amounts of sulphite, hydroquinone and possibly metol or a pyrazolidone. While such a process is better than the low sulphite 'lith' process, the developer still has a high pH requirement for it to function correctly. Such a solution is not as stable as is desirable. Additionally, high pH solutions are environmentally undesirable because of the care needed in handling and disposing of the effluent.

Unfortunately, light sensitive materials whose contrast is enhanced by the presence of a hydrazine nucleating agent show large variations in their photographic properties as the developer is exhausted or through the course of time, for example as the pH of the developer varies and in particular as the pH is lowered. The pH of the developer can vary for a number of reasons: for example, exhaustion and absorption of carbon dioxide causes the pH to drop whilst air oxidation causes the pH to rise, as can concentration through evaporation.

It is also known that a developer solution having a pH below 11 can be employed by using certain hydrazides active at this pH. Hydrazides proposed for such use are described, for example, in U.S. Pat. Nos. 4,278,748; 4,031,127; 4,030,925 and 4,323,643 and in EP-A-0 333 435. A nucleator containing both a hydrazide moiety and a nicotinamide moiety is disclosed in U.S. Pat. No. 5,288,590.

Developer solutions with these low pHs can also be used by the introduction of a contrast-promoting agent (commonly called a booster) to give adequate activity. The booster can be incorporated into the photographic layer or may be dissolved in the developer solution. The booster may be, for example, one of the boosters as described in U.S. Pat. No. 5,316,889 or an amine booster as described in U.S. Pat. Nos. 4,269,929; 4,668,605, 4,740,452 or EP-A-0 364 166. Compounds bearing different functionalities e.g. phosphonium and pyridinium, have also been shown to be active, as described in U.S. Pat. No. 5,744,279.

The disadvantages connected with the necessity of using a booster to promote nucleation are numerous. Some materials are toxic, some are excessively volatile, some have unpleasant odours, some tend to form azeotropes with water, some build up in the developer during processing, some are insufficiently soluble in an aqueous alkaline photographic developing solution and some are costly, yet must be used at a relatively high concentration such that they contribute substantially to the overall cost of the material. Moreover, many boosters exhibit a degree of activity as contrast-promoters that is less than is desired for commercial operation. In addition, a photographic system depending on the combination of nucleator and booster is an exceedingly complex system which makes its performance particularly sensitive to variation. It would be desirable therefore if good nucleation could be achieved in the absence of such a booster or with a reduced amount of such a booster.

In the non-image areas on the processed film unwanted small dots can appear and this is called 'pepper fog'. This is due to unintentionally fogged grains developing and being amplified by the nucleation process and being rendered visible. Nucleators which are unstable or more active and diffuse more rapidly can result in more and larger pepper fog spots. In high contrast materials therefore a balance needs to be achieved between vigorous development and pepper fog.

Another consideration is chemical spread (or image spread) which is a measure of the increase in size of developed dots or lines produced by nucleation of the edge of the image area causing development of the image boundary beyond the original exposed edge. This spread is small but measurable and can reduce the resolution of very fine lines.

The problem is therefore to provide a nucleator for incorporation into a photographic material or into the developer which gives ultrahigh contrast but which at the same time shows less sensitivity to variations in the developing solution, such as pH, provides sufficient activity in the presence of reduced amounts of a booster or ideally in the absence of booster, provides lower chemical spread and has significantly reduced pepper fog in the photographic material.

It has been found that these objectives can be achieved by the use of a nucleating agent comprising a dimeric molecule wherein the monomers, which are linked by a linking group, each comprise an acylhydrazide and a nicotinamide moiety. Such a nucleating agent can lead to unexpectedly good nucleation even in the absence of a booster and also in a developer whose pH is variable, with concomitant lower chemical spread and pepper fog.

SUMMARY OF THE INVENTION

According to the present invention therefore there is provided an ultrahigh contrast photographic material comprising a support bearing a silver halide emulsion layer, containing a hydrazide nucleating agent in the emulsion layer or a hydrophilic colloid layer, characterised in that the nucleating agent is a dimeric molecule comprising two monomers linked by a linking group, each monomer of which (a) may be the same or different and (b) comprises an acylhydrazide moiety and a nicotinamide moiety in combination.

In a further aspect of the invention there is provided a photographic material as defined above which also contains in the emulsion layer or a hydrophilic colloid level, a booster compound, as hereinafter defined.

In another aspect of the invention there is provided a process of forming a photographic image having ultrahigh contrast which comprises imagewise exposing a photographic material comprising a support bearing a silver halide emulsion layer and processing it with an alkaline developer solution characterised in that it is developed in the presence of a nucleating agent which is a dimeric molecule comprising two monomers linked by a linking group, each monomer of which (a) may be the same or different and (b) comprises an acylhydrazide moiety and a nicotinamide moiety in combination, optionally in the presence of a booster compound, as hereinafter defined.

The dimeric nucleating agents of the invention show less sensitivity to pH variation in the developer solution than do conventional nucleating agents, leading to significant improvements in processing robustness. Furthermore they are found to provide sufficient activity in the presence of less than the normal amount of booster or even in the absence of such a booster, with cost and environmental advantages. Additionally they provide lower chemical spread and significantly reduced or no observable pepper fog in the photographic material.

DETAILED DESCRIPTION OF THE INVENTION

The dimeric nucleators useful in the photographic materials of the invention generally have the following general formula

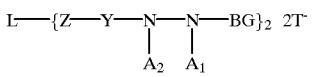

or

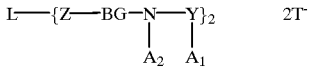

wherein each monomer linked by linking group L is the same or different;

Z is a nicotinamide residue;

Y is a substituted aryl or heterocyclic ring;

one of $A_1$ and $A_2$ is a hydrogen atom and the other is a hydrogen atom, an acyl group or an alkyl- or arylsulfonyl group, any of which may be substituted;

BG is a blocking group;

L is a linking group and $T^-$ is an anionic counterion.

In a preferred embodiment the nucleating agent has one of the following formulae G1, G2 or G3, wherein each of $A_1$ and $A_2$ are hydrogen atoms, formula G1 being the most preferred.

(G1)

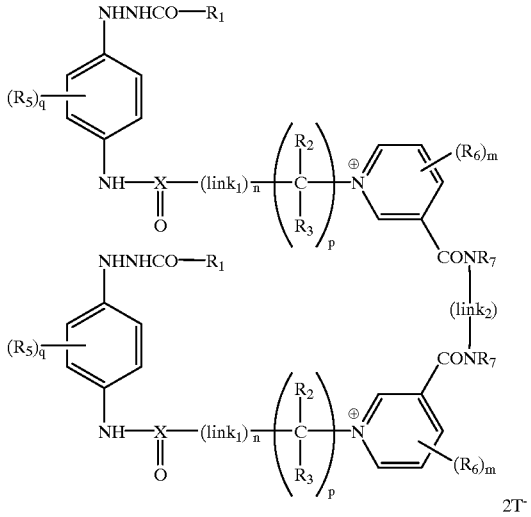

(G2)

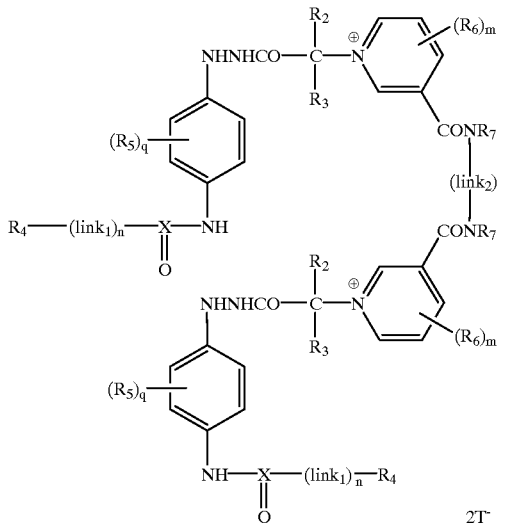

(G3)

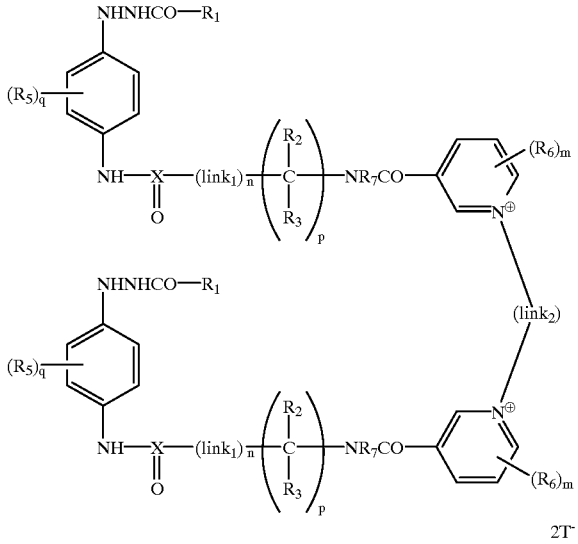

In these embodiments, each $R_1CO$ comprises a blocking group and in particular each $R_1$ is the same or different and is selected from a hydrogen atom, and an unsubstituted or substituted alkyl, aryl, alkoxy- or aryloxy-carbonyl and alkyl- or aryl-aminocarbonyl group; or each $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

each $R_2$, $R_3$ and $R_7$ are the same or different and are selected from hydrogen and an unsubstituted or substituted alkyl or aryl group and p is 0 or 1;

each $R_4$, $R_5$ and $R_6$ are the same or different and may individually or together be selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure;

each q and m are the same or different and q is an integer from 0 to 4 and m is an integer from 0 to 3;

each X is the same or different and is selected from C, S═O and C—NH;

each ($link_1$) is the same or different and is selected from an unsubstituted or substituted alkylene, polyalkylene, aryl, arylaminocarbonyl or heterocyclyl group and each n is 0 or 1; and each ($link_2$) is a linking group selected from an unsubstituted or substituted polyalkylene, polyalkylene oxide, polyalkylene containing one or more heteroatoms selected from nitrogen, oxygen and sulphur, separated from each other by alkylene groups, or an unsubstituted or substituted polyalkylene in which the alkylene groups are separated by an unsubstituted or substituted aryl or heterocyclic ring; and $T^-$ is an anionic counterion.

As used throughout this application the term alkyl refers to an unsaturated or saturated straight or branched chain alkyl group (including alkenyl) having 1–20 atoms and includes cycloalkyl having 3–8 carbon atoms. The term aryl includes aralkyl (and specifically fused aryl within its scope). The term heterocyclic specifically includes fused heterocyclic within its scope. The term polyalkylene is defined as the group $(CH_2)_n$ wherein n is an integer from 2 to 50.

The term 'blocking group' refers to a group suitable for protecting the (hydrazine) group but which is readily removable when necessary.

Although it is not critical to the function of the invention it may be convenient for the synthesis if the dimeric nucleator comprises two identical moieties linked by $(link)_2$.

It is preferred that $R_1$ is a hydrogen atom or a group selected from unsubstituted or substituted alkyl, for example methyl, trifluoromethyl, 3 -methylsulfonamido-propyl, methyl- or phenyl-sulfonylmethyl, carboxy-tetrafluoroethyl; unsubstituted or substituted aryl, for example phenyl, 3,5-dichlorophenyl, o-methane-sulfonamidophenyl, 4-methanesulfonylphenyl, 2(2'-hydroxyethyl)phenyl, 2-hydroxy-4-methylphenyl, o-hydroxybenzyl; a carbonyl-containing group, for example an alkylamino-, alkoxy-, aryloxy- or hydroxyalkylamino-carbonyl; or contains an imidazolyl, pyrazolyl, triazolyl, tetrazolyl, pyridyl, pyridinium, piperidinyl, morpholino, quinolinium or a quinolinyl group or $R_1$ may include a group which splits off a photographically useful fragment, such as a phenylmercaptotetazole or a 5-or 6-nitroindazole group. Examples of some of these are disclosed in U.S. Pat. No. 5,328,801. $R_2$ and $R_3$ are preferably hydrogen atoms or alkyl groups with p being preferably 1 and $R_4$, $R_5$ and $R_6$ are preferably hydrogen, alkyl or alkoxy groups, with q being preferably 0 or 1 and m being preferably 0. $R_7$ is preferably hydrogen or an alkyl group, optionally substituted with, for example, a dialkylamino group.

When X is S=0 it is preferred that n is 1 and that ($link_1$) comprises an arylamino group or an aryl-aminocarbonyl group, preferably a phenylaminocarbonyl group, which may be substituted in the ring, for example, with one or more alkyl, carboxyl groups or halogen atoms. When X is C or C—NH it is preferred that n is 0 such that no ($link_1$) group is present.

The ($link_2$) group preferably comprises a polyalkylene group comprising alkylene groups, preferably methylene groups, typically four or six, which may be separated by one or more O or S atoms. For example ($link_2$) may be $(CH_2)_4$, $(CH_2)_6$, $(CH_2)_2S(CH_2)_2$ or $(CH_2)_2O(CH_2)_2O(CH_2)_2$. Alternatively ($link_2$) may be a polyalkylene oxide chain extending from an even number of methylene groups such as $(CH_2CH_2O)_{14}CH_2CH_2$ or may comprise, for example a $CH_2C_6H_4CH_2$ group.

The anionic counterion may be selected from any well known in the art and may typically be selected from $Cl^-$, $Br^-$, $I^-$, $CF_3COO^-$, $CH_3SO_3^-$ and $TsO^-$.

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned.

Suitably, the group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4di-t-pentylphenoxy) propyl, and tetradecyl; alkenyl, such as ethylene, 2-butene; alkoxy, such as methoxy, ethoxy, propoxy, butoxy, 2-methoxy-ethoxy, sec-butoxy, hexyloxy, 2-ethylhexyloxy, tetra-decyloxy, 2-(2,4-di-t-pentylphenoxy)ethoxy, and 2-do-decyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzanido, butyramido, tetradecanamido, alpha-(2,4-di-t-pentylphenoxy)acetamido, alpha-(2,4-di-t-pentyl-phenoxy)butyramido, alpha-(3-pentadecylphenoxy)-hexanamido, alpha-(4-hydroxy-3-t-butylphenoxy-tetradecanamido, 2-oxo-pyrrolidin-1-yl, 2-oxo-5-tetra-decylpyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonyl-amino, benzyloxycarbonylamino, hexadecyloxycarbonyl-amino, 2,4-di-t-butylphenoxycarbonylamino, phenylcarbonylamino, 2,5 -(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecyl-ureido, N,N-di-octyl-N'-ethylureido, N-phenylureido, N,N-diphenyl-ureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-di-propylsulfamoyl-amino, and hexadecylsulfonamido; sulfamoyl, such as N-methylsulfamoyl, N-ethylsulfamoyl, N,N-dipropyl-sulfamoyl, N-hexadecylsulfamoyl, N,N-dimethyl-sulfamoyl; N-[3-(dodecyloxy)propyl]sulfamoyl, N-[4-(2,4-di-t-pentylphenoxybutyl]sulfamoyl, N-methyl-N-tetradecylsulfamoyl, and N-dodecylsulfamoyl; carbamoyl, such as N-methylcarbamoyl, N,N-dibutyl-carbamoyl, N-octadecylcarbamoyl, N-[4-(2,4-di-t-pentylphenoxy) butyl]carbamoyl, N-methyl-N-tetra-decylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxy-carbonyl, butoxycarbonyl, tetradecyloxycarbonyl, ethoxycarbonyl, benzyloxycarbonyl, 3-pentadecyloxy-carbonyl, and dodecyloxycarbonyl; sulfonyl, such as methoxysulfonyl, octyloxysulfonyl, tetradecyloxy-sulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenyl-sulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecyl-sulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octyl-phenylthio, and p-tolylthio; acyloxy, such as acetyloxy, benzoyloxy, octadecanoyloxy, p-dodecylamidobenzoyloxy, N-phenylcarbamoyloxy, N-ethyl-carbamoyloxy, and cyclo-hexylcarbonyloxy; amine, such as phenylanilino, 2-chloroanilino, diethylamine, dodecylamine; imido, such as 1 N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzo-thiazolyl; quaternary ammonium, such as tri-ethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups and groups which adsorb to silver halide. Generally, the above groups and substituents thereof may include those having up to 48 carbon atoms, typically 1 to 36 carbon atoms and usually less than 24 carbon atoms, but greater numbers are possible depending on the particular substituents selected.

In some embodiments, the nucleators of the invention may be selected from the following:

(N1)

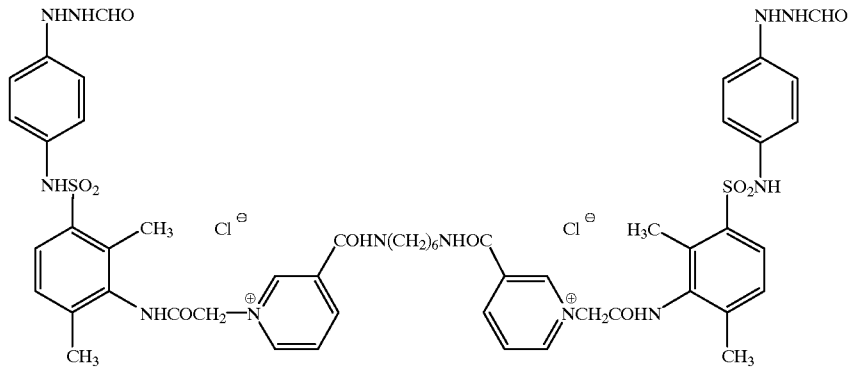

(N2)

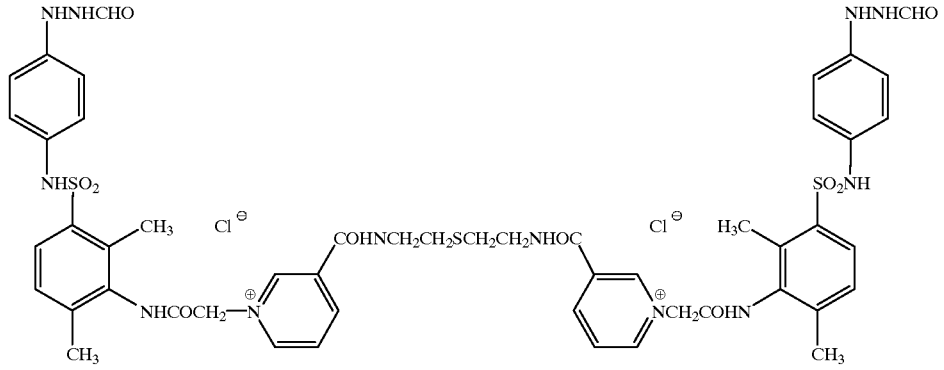

-continued
(N3)
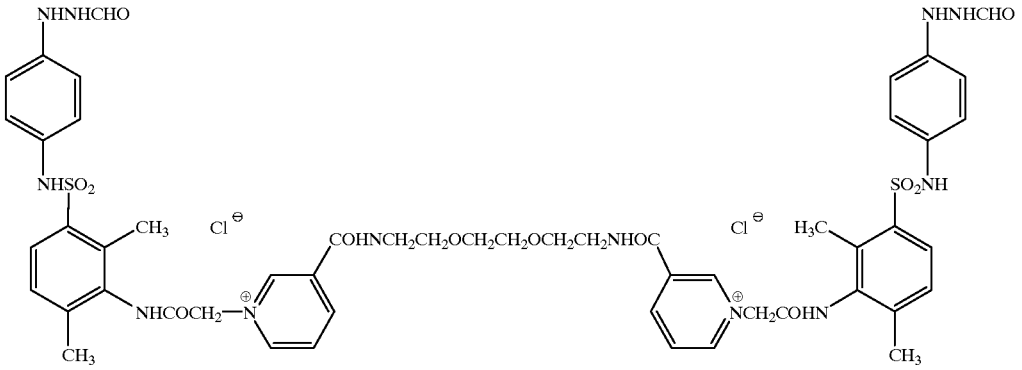
(N4)
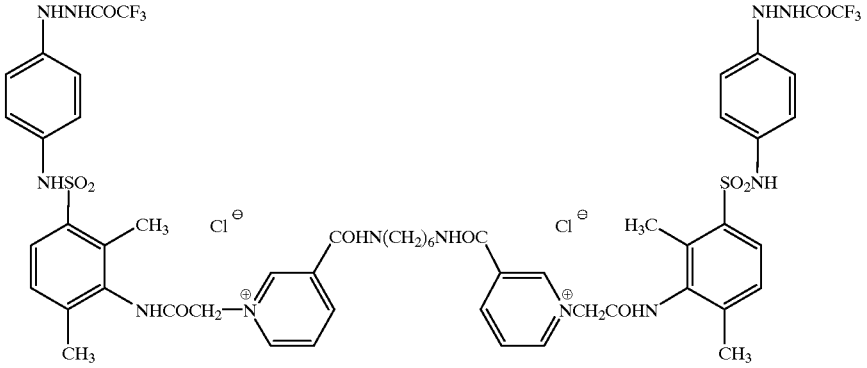
(N5)
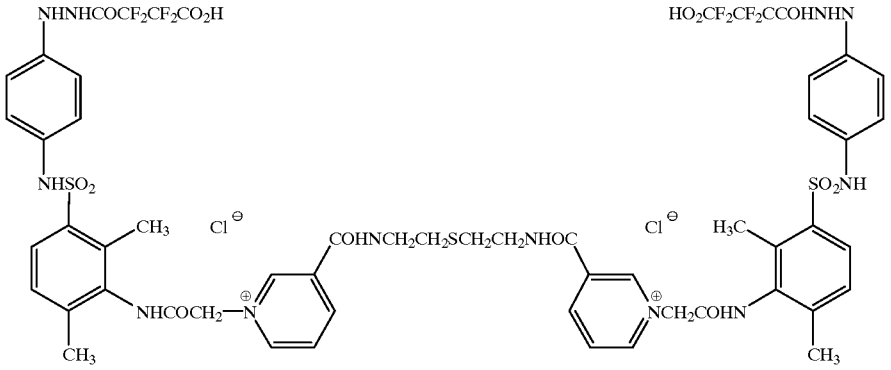
(N6)
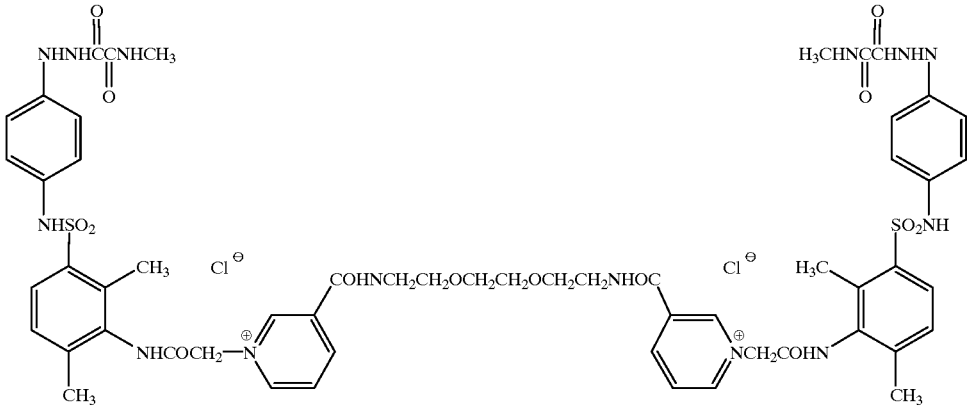

-continued
(N7)
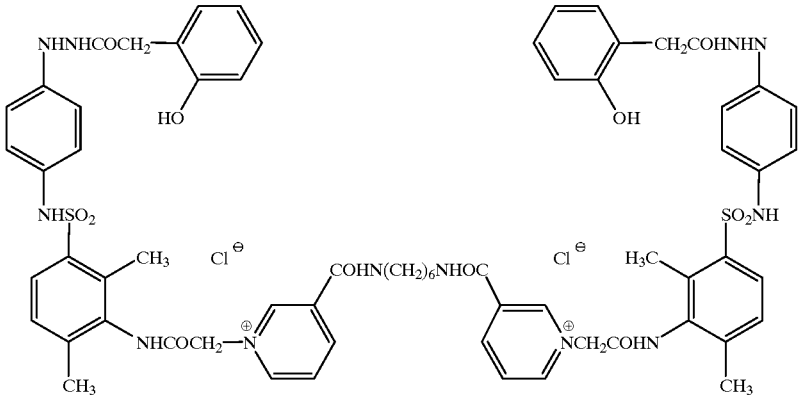
(N8)
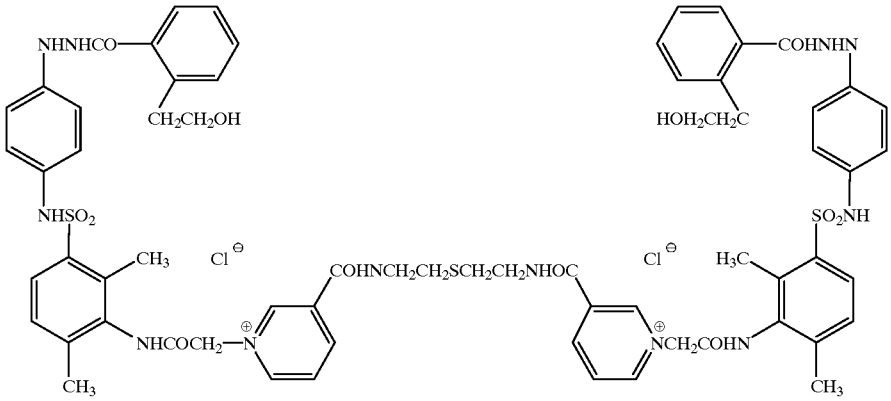
(N9)
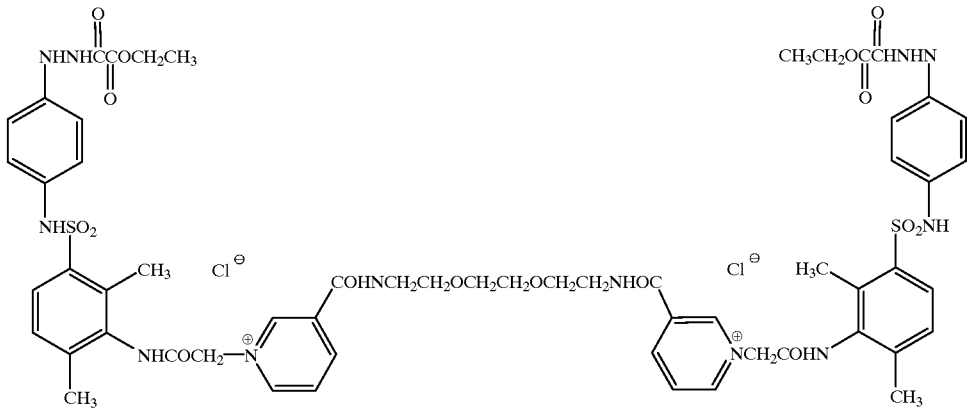
(N10)
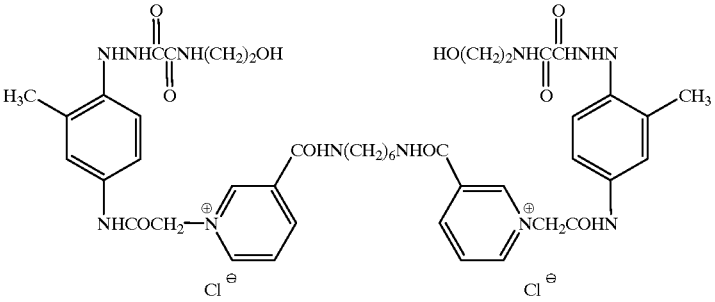

-continued
(N11)
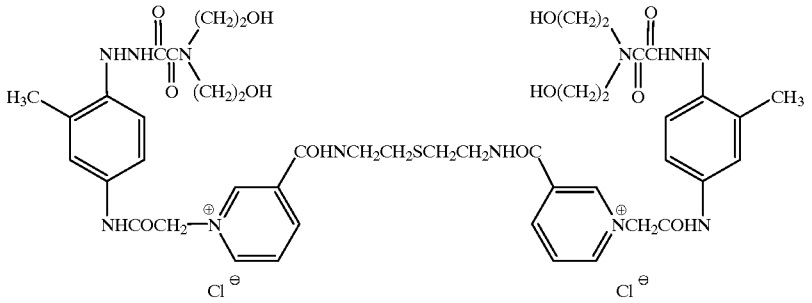
(N12)
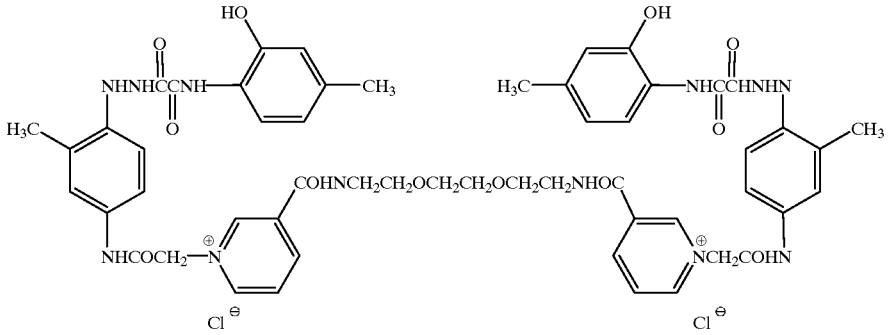
(N13)
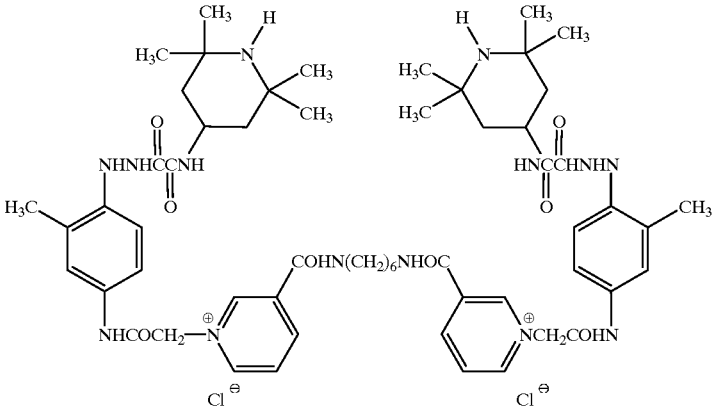
(N14)
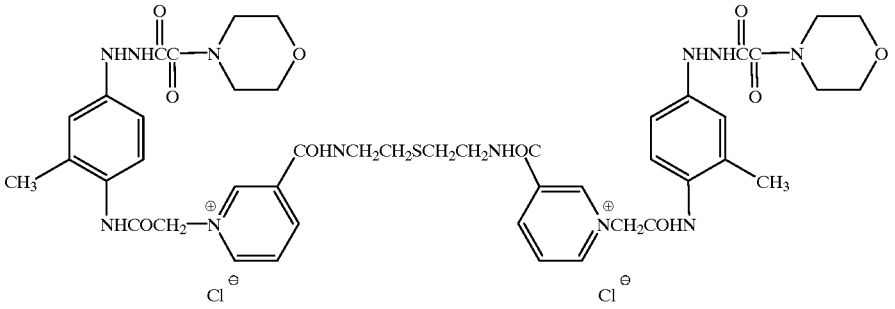

-continued
(N15)
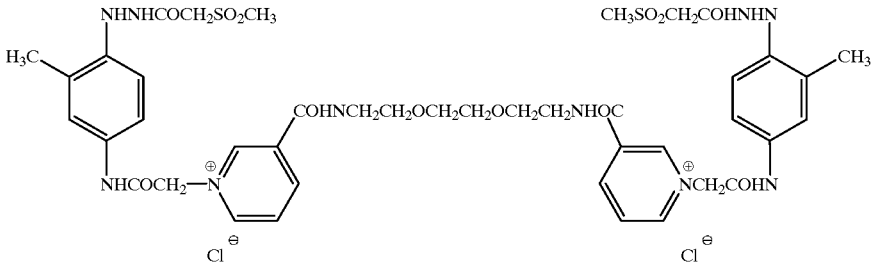
(N16)
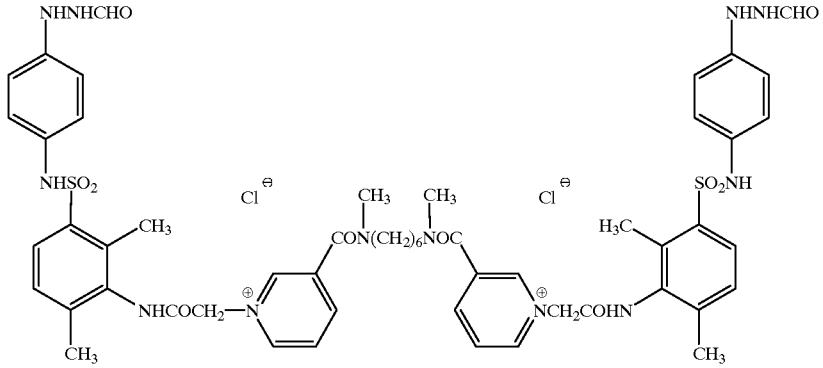
(N17)
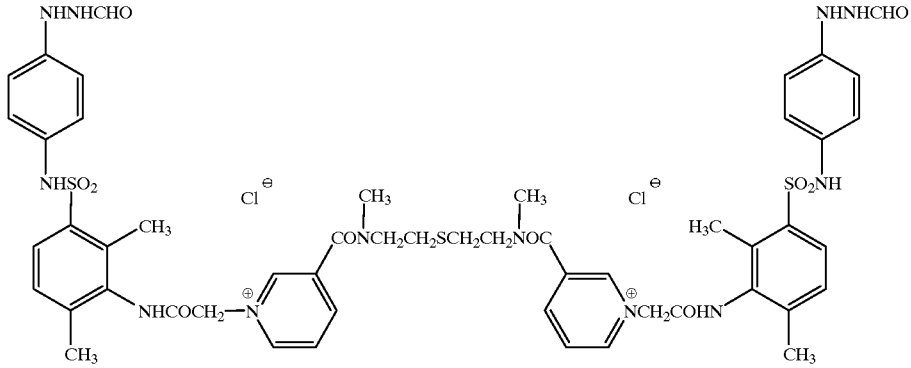
(N18)
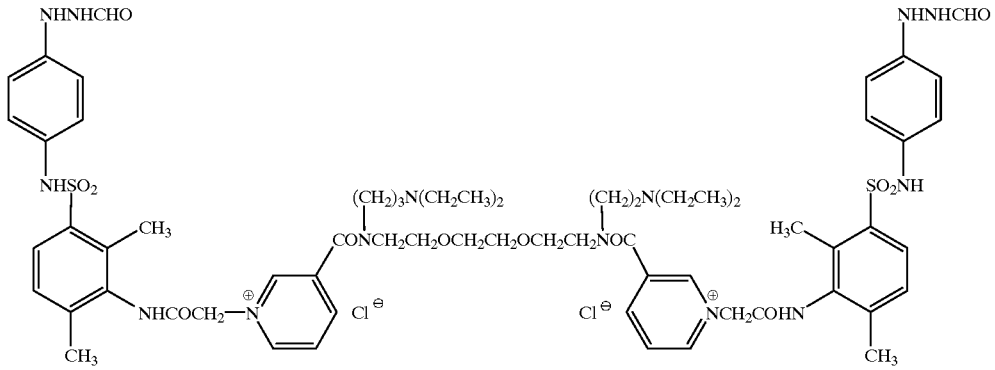

-continued
(N19)
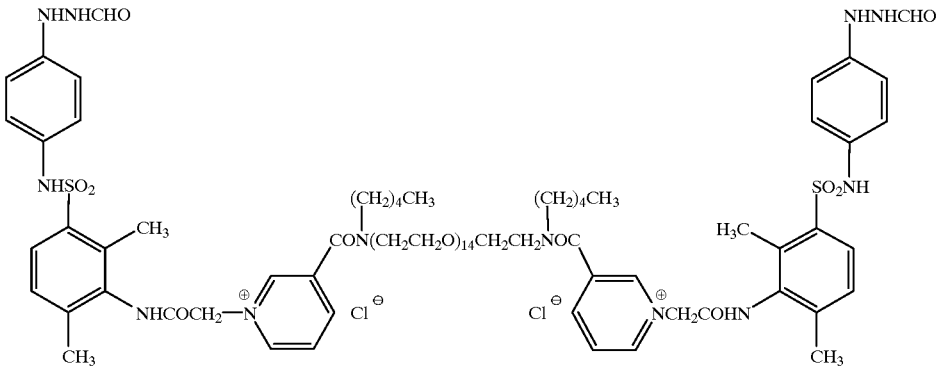
(N20)
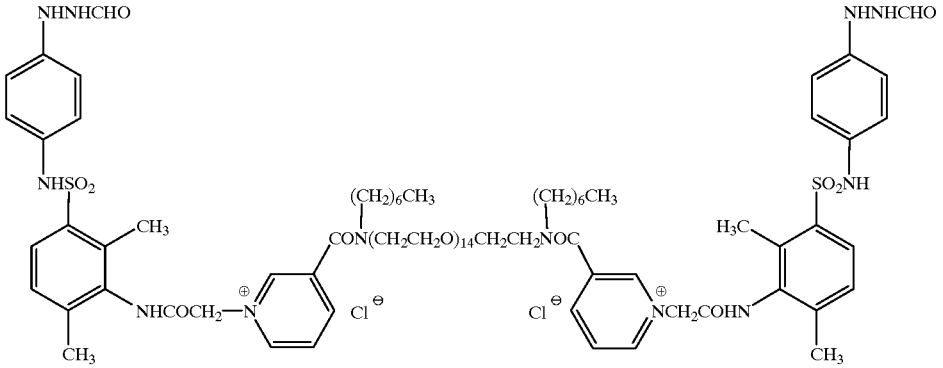
(N21)
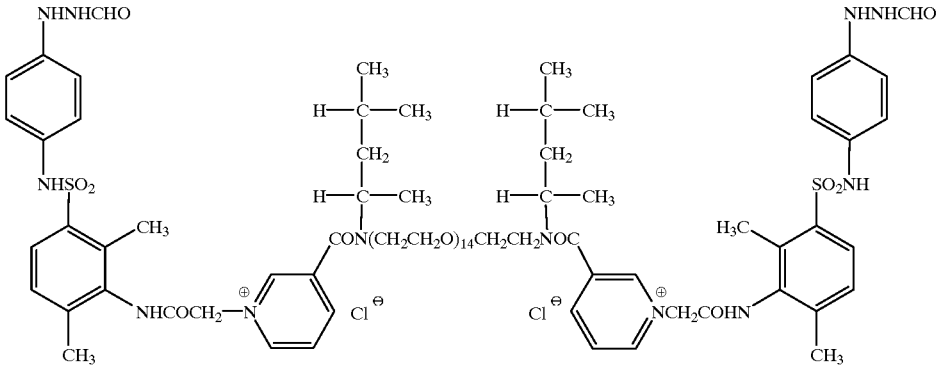
(N22)
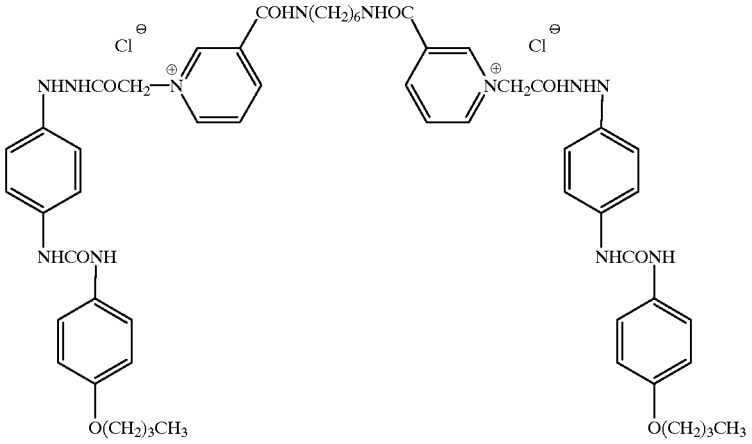

-continued
(N23)
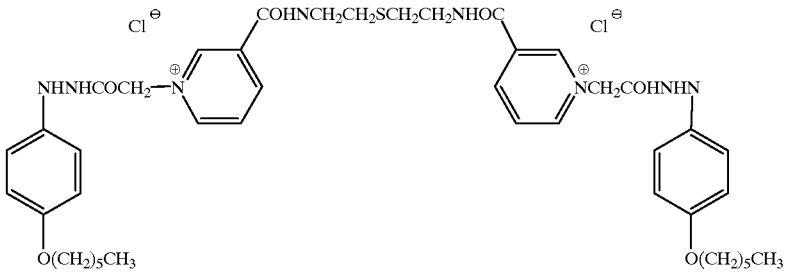
(N24)
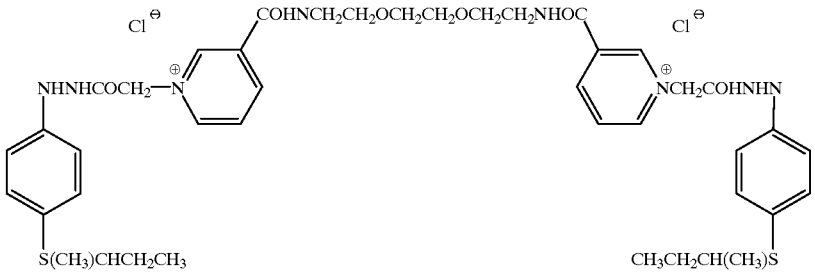
(N25)
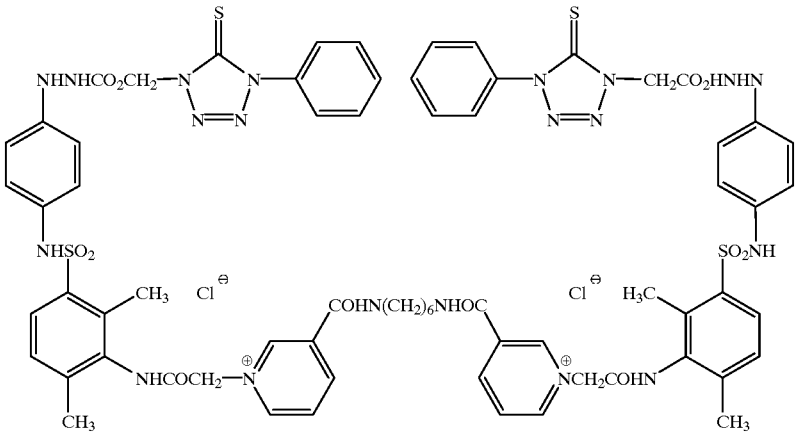
(N26)
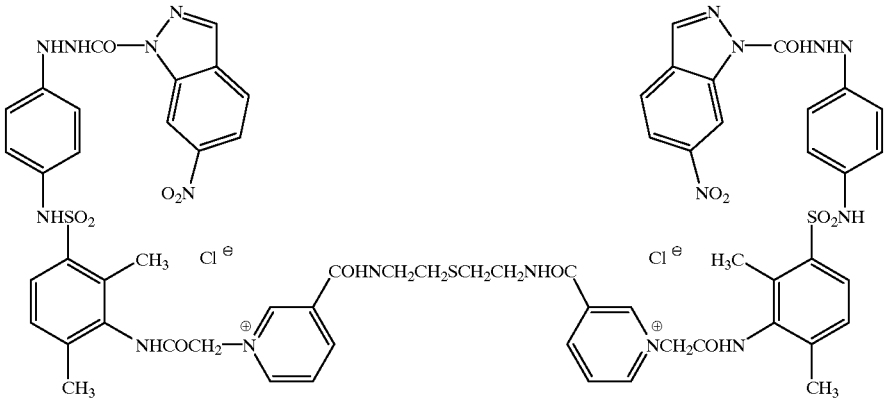

-continued
(N27)
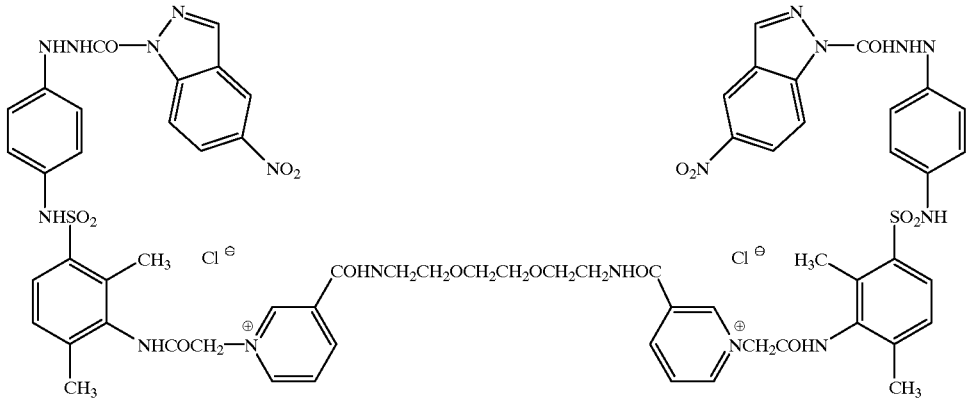
(N28)
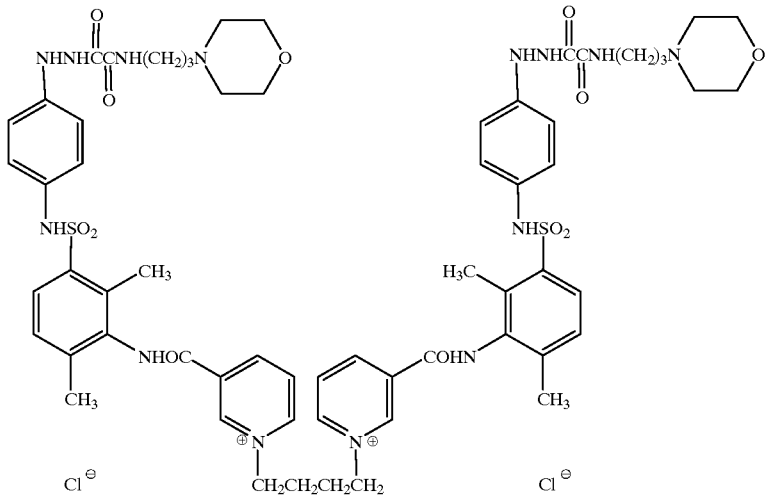
(N29)
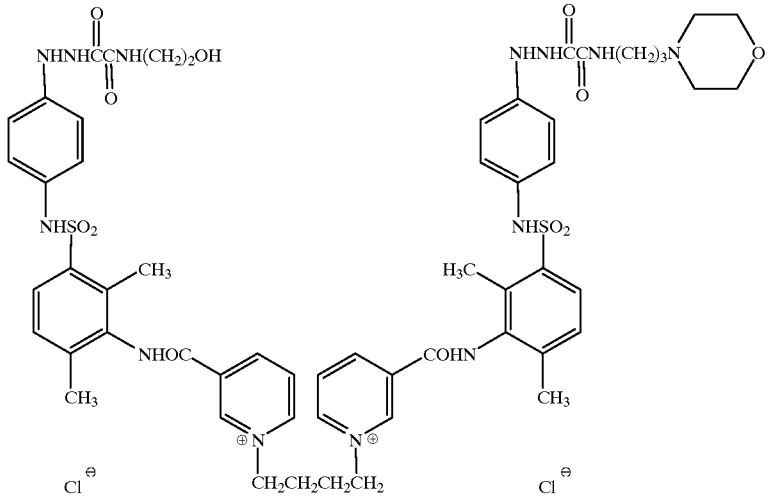

-continued
(N30)
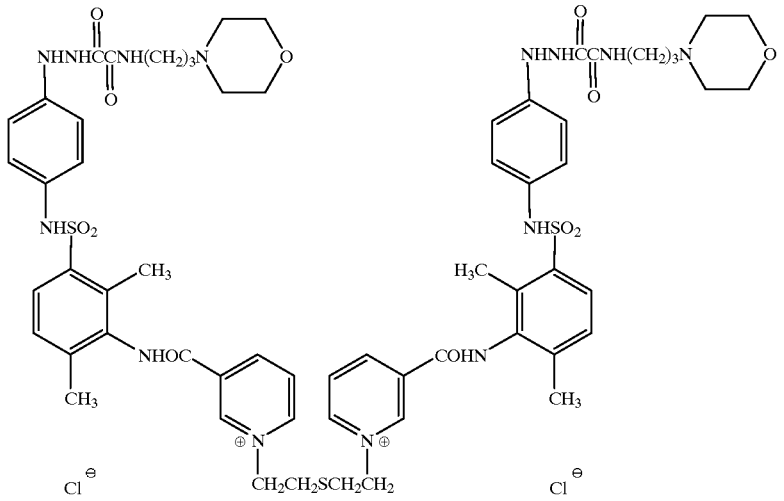
(N31)
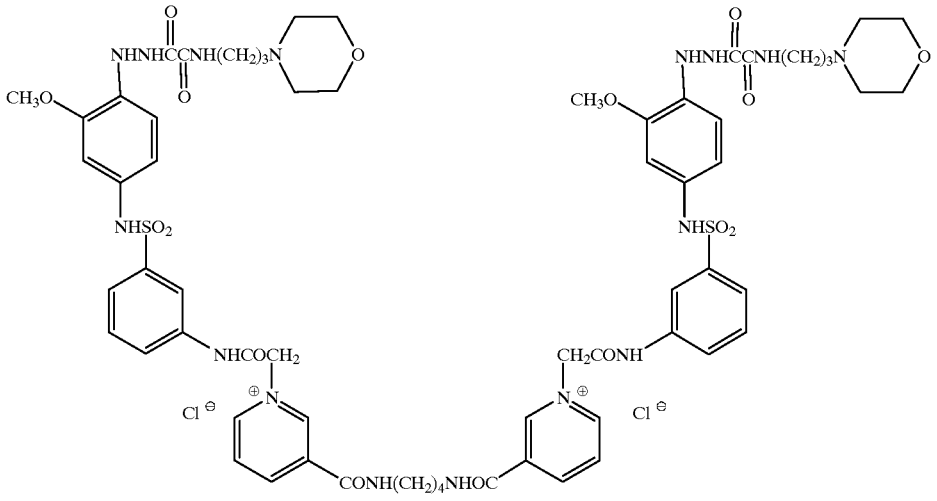
(N32)
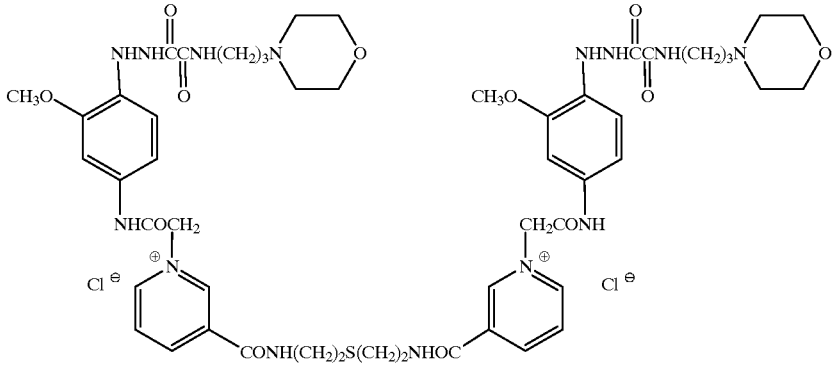

-continued
(N33)
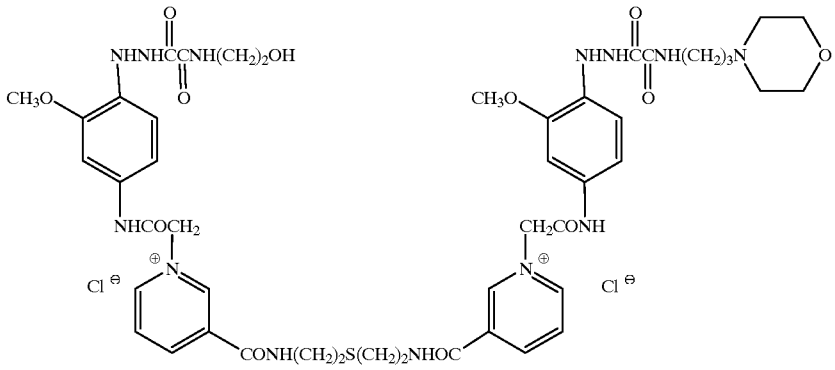
(N34)
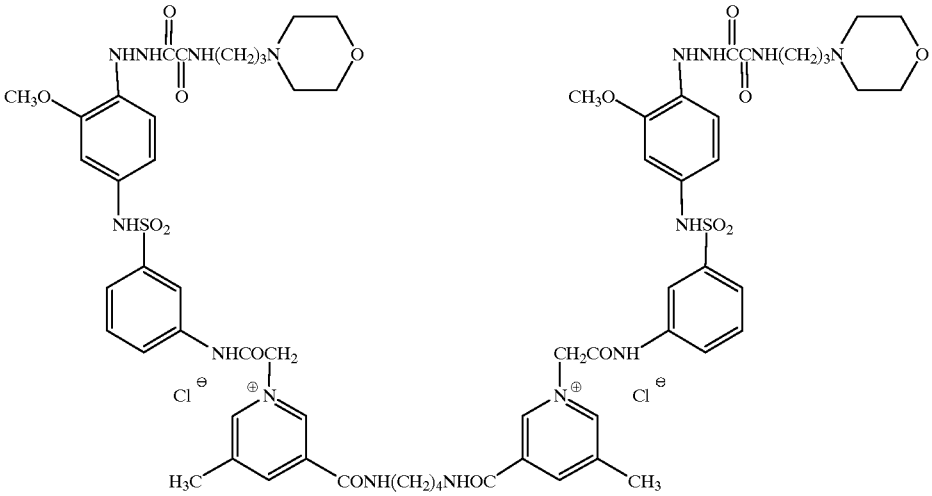
(N35)
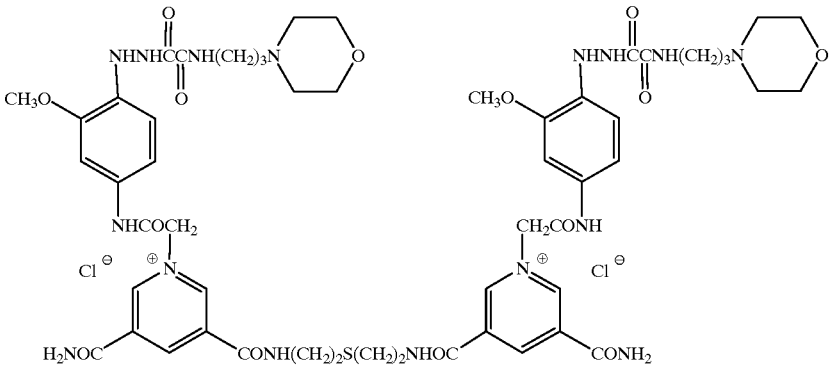
(N36)
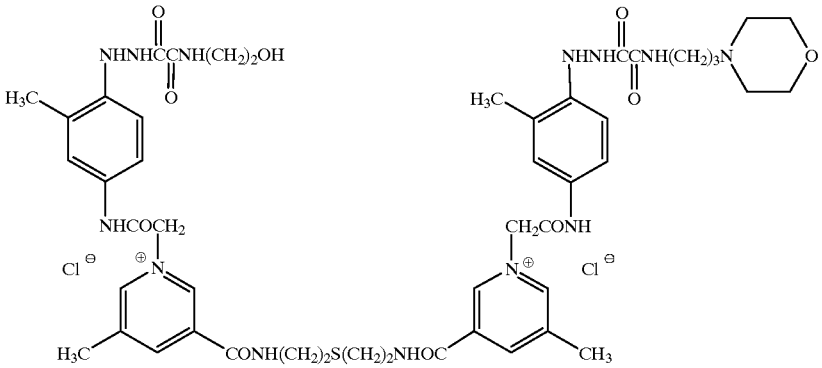

-continued
(N37)
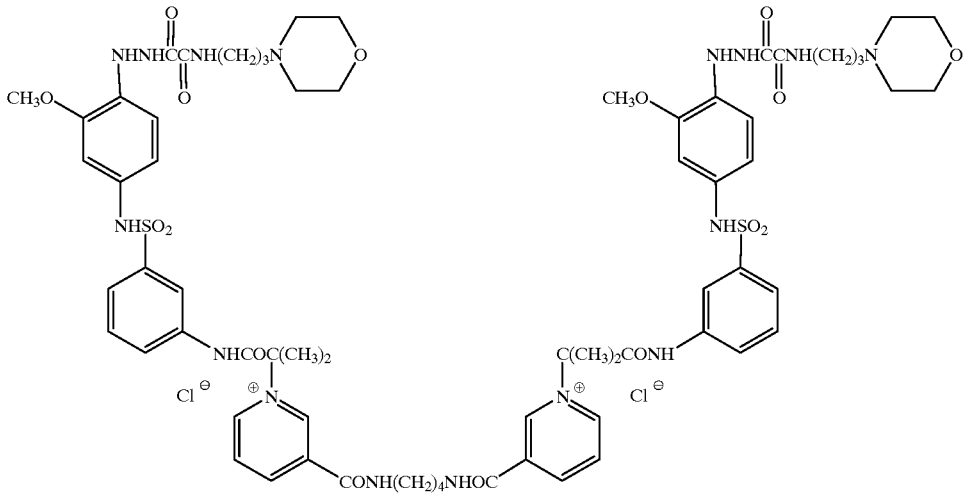
(N38)
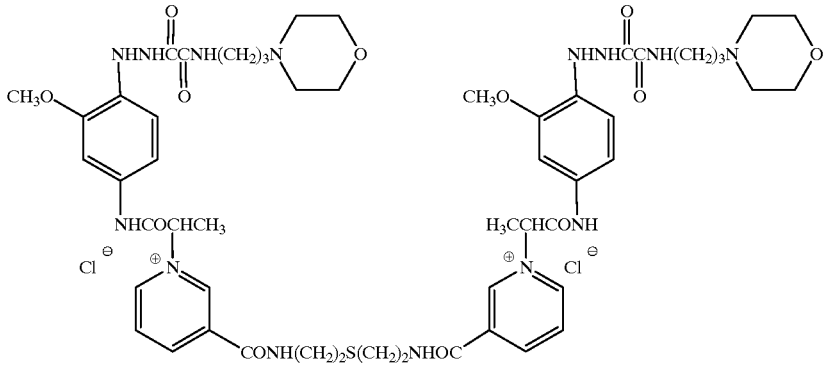
(N39)
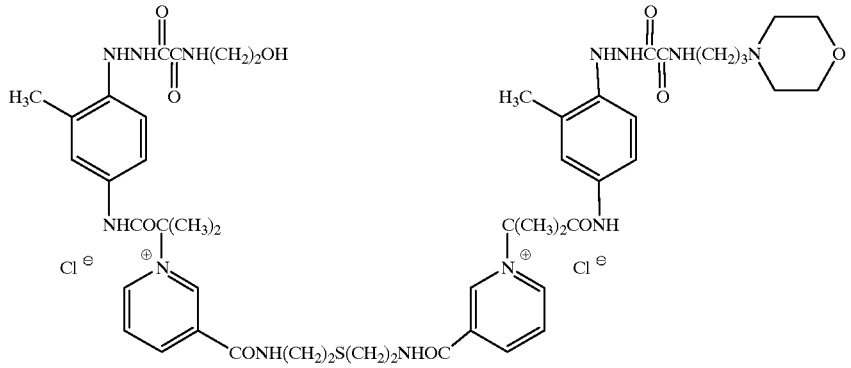

-continued
(N40)
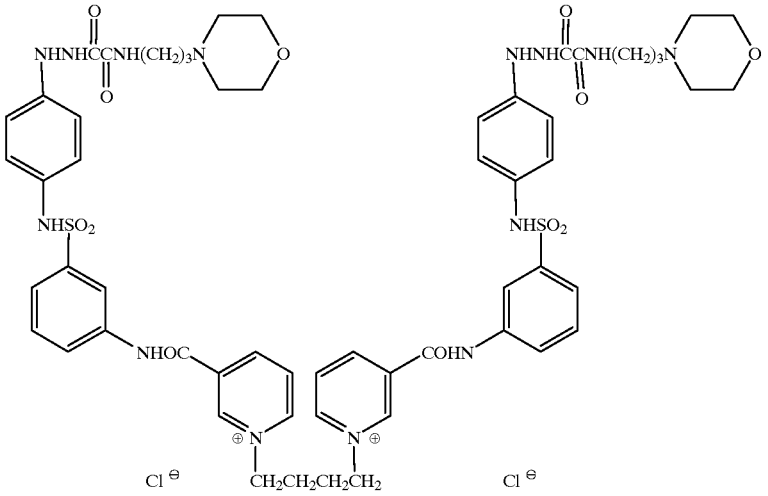
(N41)
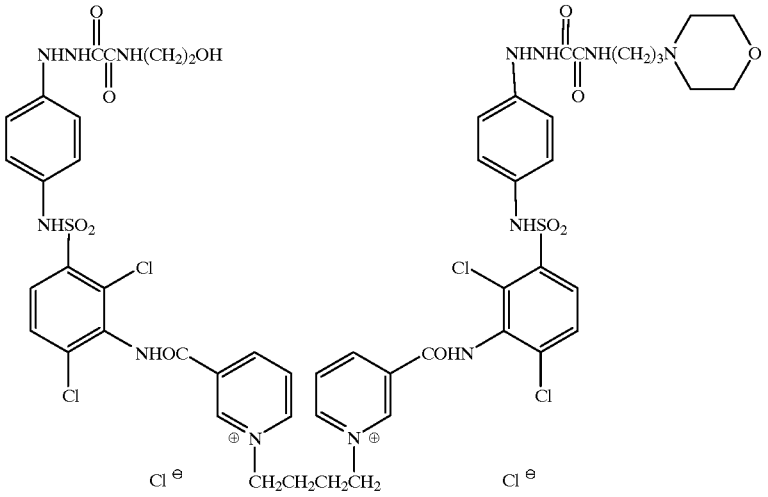
(N42)
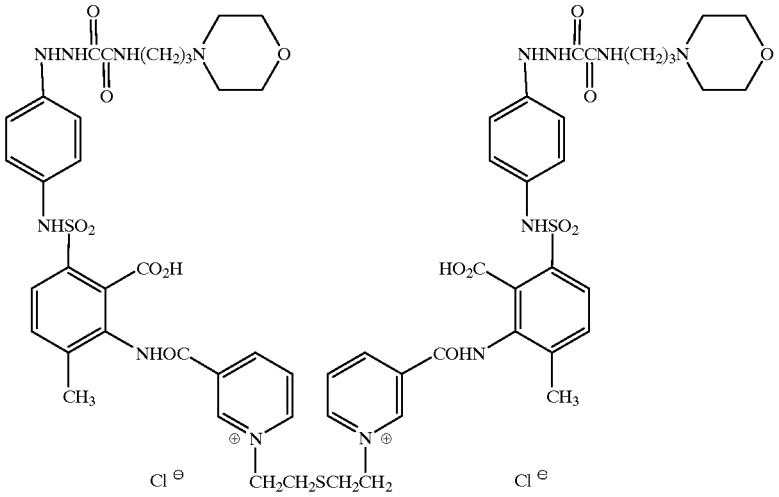

The photographic material of the invention may also contain a booster compound to enhance the ultrahigh contrast and to promote activity, although as previously mentioned the use of the dimeric nucleators described herein means that the amount of any such booster can be substantially reduced. Alternatively the booster compound can be present in the developer solution.

One class of such boosters are amines that (1) comprise at least one secondary or tertiary amino group, and (2) have an n-octanol/water partition coefficient (log P) of at least one, preferably at least three, and most preferably at least four, log P being defined by the formula:

$$\log P = \log\frac{[X_{octanol}]}{[X_{water}]}$$

wherein X is the concentration of the amino compound.

Preferably such an amine contains within its structure a group comprising at least three repeating ethyleneoxy units as described in U.S. Pat. No. 4,975,354. These units are preferably directly attached to the nitrogen atom of a tertiary amino group.

Included within the scope of the amino compounds which may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds having at least 20 carbon atoms.

Preferred amino compounds for inclusion in photographic materials of the invention are bis-tertiary-amines which have a partition coefficient of at least three and a structure represented by the formula:

$$R^1R^2N—(CH_2CH_2O)n—CH_2CH_2—NR^3R^4$$

wherein n is an integer from 3 to 50, and more preferably 10 to 50; $R^1$, $R^2$, $R^3$ and $R^4$ are, independently, alkyl groups of 1 to 8 carbon atoms, or $R^1$ and $R^2$ taken together represent the atoms necessary to complete a heterocyclic ring, and/or $R^3$ and $R^4$ taken together represent the atoms necessary to complete a heterocyclic ring.

A particularly preferred booster for use in photographic materials of the invention or in the developer therefor is the booster B1 wherein in the above formula $R_1$, $R^2$, $R^3$ and $R^4$ are each n-propyl groups and n is 14, i.e. the structure (B1)

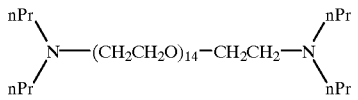

B1

Another preferred group of amino compounds are bis-secondary amines which have a partition coefficient of at least three and a structure represented by the formula:

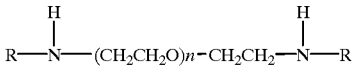

wherein n is an integer from 3 to 50, and more preferably 10 to 50, and each R is, independently, a linear or branched, substituted or unsubstituted, alkyl group of at least 4 carbon atoms.

Particular amines suitable as booster compounds are listed in EP-A-0 364 166.

Other types of boosters are described in U.S. Pat. No. 5,744,279 as having one of the formulae:

$$Y((X)_n-A-B)_m \quad (a)$$

wherein

Y is a group which adsorbs to silver halide,

X is a divalent linking group composed of hydrogen, carbon, nitrogen and sulphur atoms, A is a divalent linking group, B is an amino group which may be substituted or an ammonium group of a nitrogen-containing heterocyclic group, m is 1, 2 or 3 and n is 0 or 1, $$R^1R^2N-R^3-(X)_n-SM_x \quad (b)$$

wherein $R^1$ and $R^2$ are each hydrogen or an aliphatic group, or $R^1$ and $R^2$ may together form a ring, $R^3$ is a divalent aliphatic group, X is a divalent heterocyclic ring having at least one nitrogen, oxygen or sulphur atom as heteroatom, n is 0 or 1, M is hydrogen or an alkali metal atom, alkaline earth metal atom, a quaternary ammonium, quaternary phosphonium atom or an amidino group, and x is 1 when M is a divalent atom;

said compound optionally being in the form of an addition salt;

(c) a phosphonium structure as disclosed in col. 8 of U.S. Pat. No. 5,744,279 and as exemplified by the following formula:

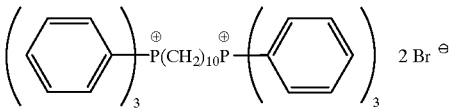

(d) a pyridinium structure as disclosed in col. 21 of the aforementioned U.S. Patent as exemplified by the following formula:

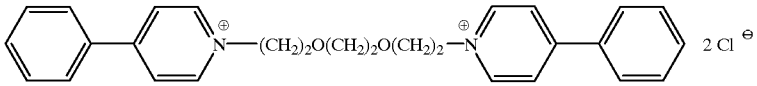

The nucleator and optionally the booster compound can be incorporated in the photographic element, for example it can be incorporated in a silver halide emulsion layer. Alternatively it can be present in a hydrophilic colloid layer of the photographic element, preferably a hydrophilic layer which is coated to be adjacent to the emulsion layer in which the effects of the nucleator are desired It can however be present in the photographic element distributed between or among emulsion and hydrophilic colloid layers, such as undercoating layers, interlayers and overcoating layers.

Typically the nucleator may be present in the photographic material in an amount of from about 1 $\mu$mol/m$^2$ to about 100 $\mu$mol/m$^2$, preferably 3 $\mu$mol/m$^2$ to 50 $\mu$mol/m$^2$, more preferably 5 $\mu$mol/m$^2$ to 20 $\mu$mol/m$^2$. Corresponding amounts for the booster are from 0 mol/m$^2$ to about 1 mmol/m$^2$, preferably 10 $\mu$mol/m$^2$ to 100 $\mu$mol/m$^2$, most preferably 30 $\mu$mol/m$^2$ to 100 $\mu$mol/m$^2$.

The emulsions employed in photographic materials of the invention and the addenda added thereto, the binders, supports etc. may be as described in Research Disclosure Item 36544, September 1994, published by Kenneth Mason Publications, Emsworth, Hants, PO10 7DQ, United Kingdom, which will be identified hereinafter by the term "Research Disclosure."

The hydrophilic colloid may be gelatin or a gelatin derivative, polyvinylpyrrolidone or casein and may contain a polymer. Suitable hydrophilic colloids and vinyl polymers and copolymers are described in Section IX of the *Research Disclosure.* Gelatin is the preferred hydrophilic colloid. The photographic materials may also contain an overcoat hydrophilic colloid layer which may also contain a vinyl polymer or copolymer located as the last layer of the coating (furthest from the support). It contains one or more surfactants to aid coatability and may also contain some form of matting agent. The vinyl polymer is preferably an acrylic polymer and preferably contains units derived from one or more alkyl or substituted alkyl acrylates or methacrylates, alkyl or substituted alkyl acrylamides, or acrylates or acrylamides containing a sulfonic acid group.

The photographic materials of the invention preferably contain an antihalation layer which may be on either side of the support, preferably on the opposite side of the support from the emulsion layer. In a preferred embodiment an antihalation dye is contained in the hydrophilic colloid underlayer. The dye may also be dissolved in or dispersed in the underlayer. Suitable dyes are listed in the *Research Disclosure* disclosed above.

The emulsions are preferably chemically sensitised, for example with both sulphur and gold. The latent-image forming grains can be bromoiodide, chlorobromo-iodide, bromide, chlorobromide, chloroiodide or chloride, preferably chlorobromide. They should be preferably be spectrally sensitised. More than one type of spectrally sensitised silver halide grain may be present and hence grains sensitised to different spectral regions may be present in the emulsion layer.

The coating may be made by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in EP-A-0 682 288.

The silver halide grains may be doped with rhodium, ruthenium, iridium or other Group VIII metals either alone or in combination, preferably at levels in the range $10^{-9}$ to $10^{-3}$, preferably $10^{-6}$ to $10^{-3}$ mole metal per mole of silver. The grains may be mono- or poly-disperse. The preferred Group VIII metals are rhodium and/or iridium and ammonium pentachlororhodate may conveniently be used.

The present photographic materials are particularly suitable for exposure by red or infra-red laser diodes, light emitting diodes or gas lasers, e.g a Helium/Neon or Argon laser.

The light-sensitive silver halide contained in the photographic elements can be processed following exposure to form a visible image by associating the silver halide with an aqueous alkaline medium in the presence of a developing agent contained in the medium or the element. The photographic elements of this invention can be processed in conventional developers as opposed to specialised developers sometimes employed in conjunction with lithographic photographic elements to obtain very high contrast images. When the photographic elements contain incorporated developing agents the elements can be processed in the presence of an activator, which can be identical to the developer in composition, but otherwise lacking a developing agent. Very high contrast images can be obtained at pH values below 11, preferably in the range of from 10.0 to 10.8, preferably in the range of 10.3 to 10.5 and especially at pH 10.4.

The developers are typically aqueous solutions, although organic solvents, such as diethylene glycol, can also be included to facilitate the solution of organic components. The developers contain one or a combination of conventional developing agents, such as, for example, a polyhydroxybenzene, aminophenol, paraphenylenediamine, ascorbic acid, pyrazolidone, pyrazolone, pyrimidine, dithionite, hydroxylamine.

It is preferred to employ hydroquinone and 3-pyrazolidone developing agents in combination. The pH of the developers can be adjusted with alkali metal hydroxides and carbonates, borax and other basic salts. It is, as previously mentioned, a particular advantage of the present invention that the use of a dimeric nucleator as described herein reduces the sensitivity of the photographic material to changes in this developer pH.

To reduce gelatin swelling during development, compounds such as sodium sulphate can be incorporated into the developer. Chelating and sequestering agents, such as ethylenediaminetetraacetic acid or its sodium salt, can be present. Generally any conventional developer can be used in the practice of this invention. Specific illustrative photographic developers are disclosed in the Handbook of Chemistry and Physics, 36$^{th}$ Edition, under the title "Photographic Formulae" at page 30001 et seq. and in "Processing Chemicals and Formulas." 6$^{th}$ Edition, published by Eastman Kodak Company (1963).

The invention will now be described with reference to the following examples which are in no way to be considered as limiting the scope thereof.

EXAMPLE 1

Preparation of Nucleating Agent N1

The following preparation of nucleator (N1) is illustrative for the nucleators of this invention of formula G1. All the compounds prepared had infra-red, mass and NMR spectra which were in accordance with pure samples of the desired products.

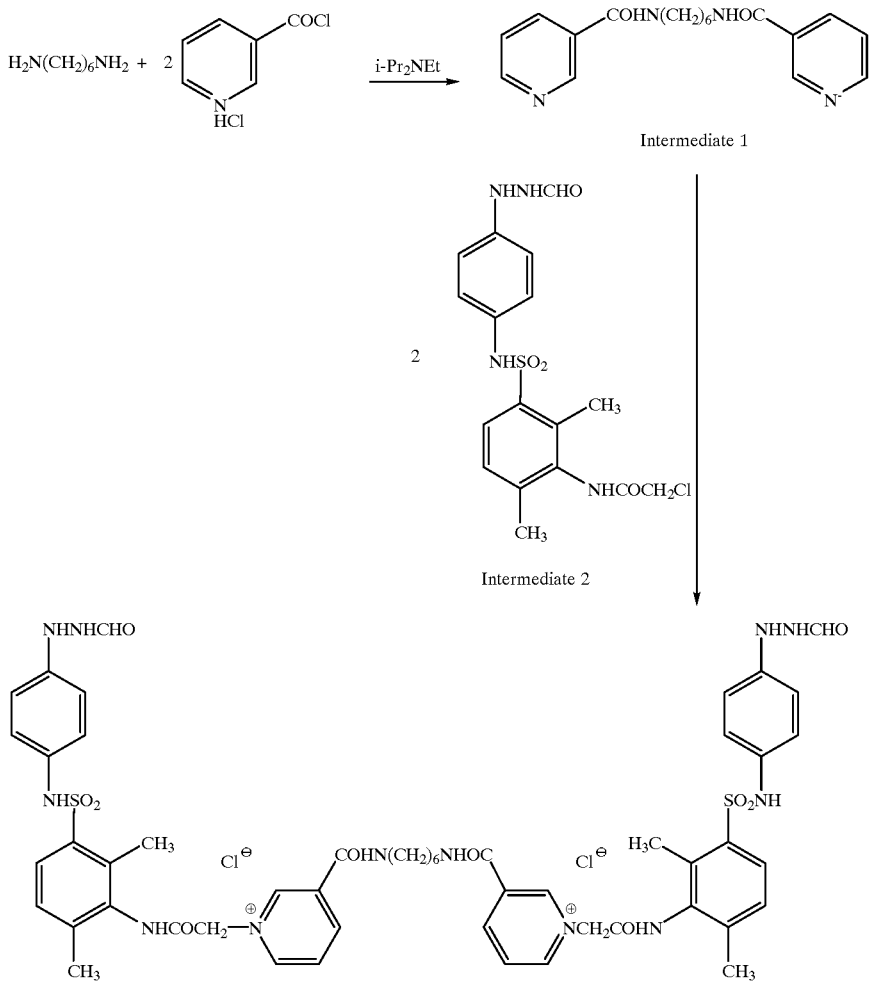

(N1)

Intermediate 1

Hexane-1,6-diamine (11.6 g, 0.1 mol) was dissolved in dry tetrahydrofuran (500 ml), with N,N-di-isopropyl-ethylamine (51.7 g, 0.4 mol). A solution of nicotinoyl chloride hydrochloride (35.6 g, 0.2 mol) in dry dimethyl-formamide (400 ml) was added dropwise, with stirring. The mixture was stirred overnight at room temperature, then concentrated under reduced pressure (to approximately 150 ml) and added to ice/water (2 l). The fine white precipitate was filtered off and dried under vacuum to obtain intermediate 1 (21.3 g, 65.2%).

Intermediate 2

A solution of 1-formyl-2-(4-nitrophenyl)hydrazine (5.4 g, 0.03 mole) in N,N-dimethylacetamide (50 ml) was reduced by contact, for 1 h, at elevated pressure and in the presence of a 10% palladium on carbon catalyst, with hydrogen and the resulting solution of product was dried and filtered. The filtrate was stirred at ice temperature while N,N-di-isopropylethylamine (3.9 g, 0.03 mole) was added followed by 2,4-dimethyl-3-(chloroacetamido) benzenesulfonyl chloride (9.8 g, 0.03 mole). The resulting solution was allowed to warm to room temperature and stand for 15 h before being dripped into 500 ml water, so that solid separated. The solid was collected, washed with water and digested for 1 h at 60° C. with 100 ml acetonitrile to give 9.7 g (79%) yield of intermediate 2 with a melting point of 210°–211° C.

Inventive Compound (N1)

The formylhydrazine (intermediate 2) (16.4 g, 0.04 mol) and intermediate 1 (6.5 g, 0.02 mol) were dissolved in dimethylacetamide (50 ml) and heated at 90° C. (oil bath temperature) for 24 h. The reaction mixture was cooled, dissolved in methanol (60 ml) and added dropwise to di-isopropyl ether (1.5 l) with stirring. The tacky brown solid was slurried in acetonitrile (3×750 ml) to obtain a buffcoloured solid (18.7 g, 81.4%) which was dried at 30° C. under vacuum. The product was stored in a vacuum desiccator.

EXAMPLE 2

Preparation of Nucleating Agent N22

Analogously with the above preparation, the following synthetic route for the preparation of nucleator (N22) is illustrative for the nucleators of this invention of formula G2:

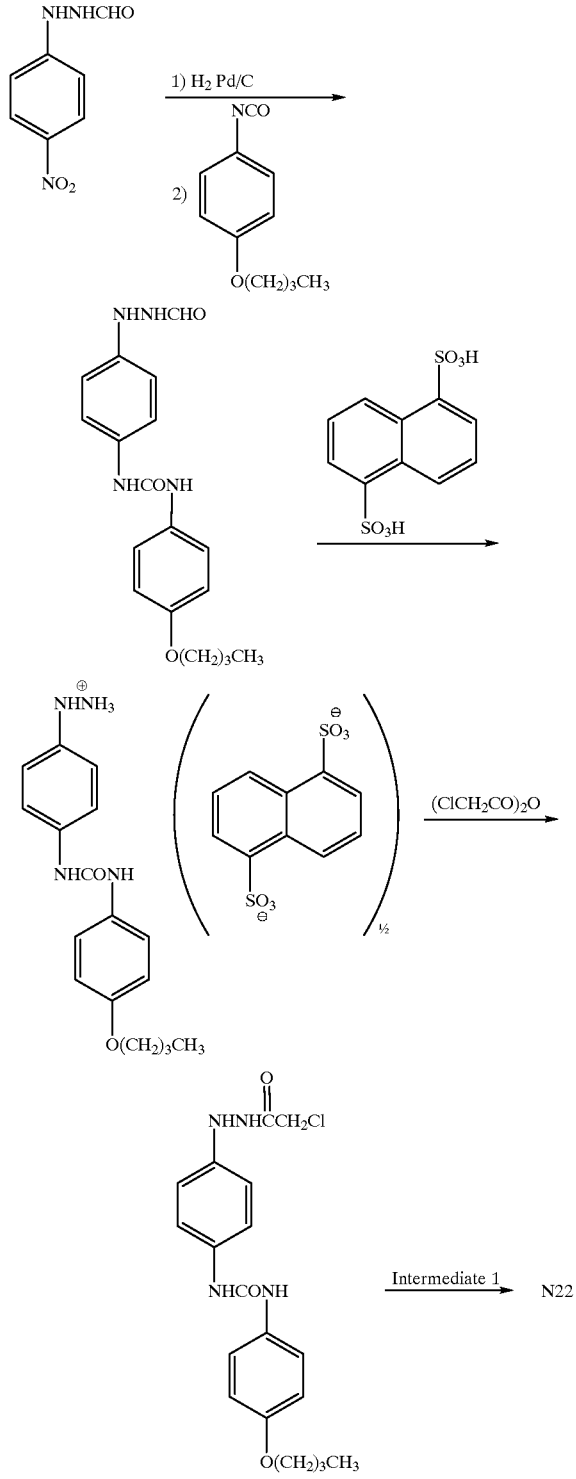

EXAMPLE 3

Preparation of Nucleating Agent N28

Analogously with the above preparation, the following synthetic route for the preparation of nucleator (N28) is illustrative for the nucleators of this invention of formula G3.

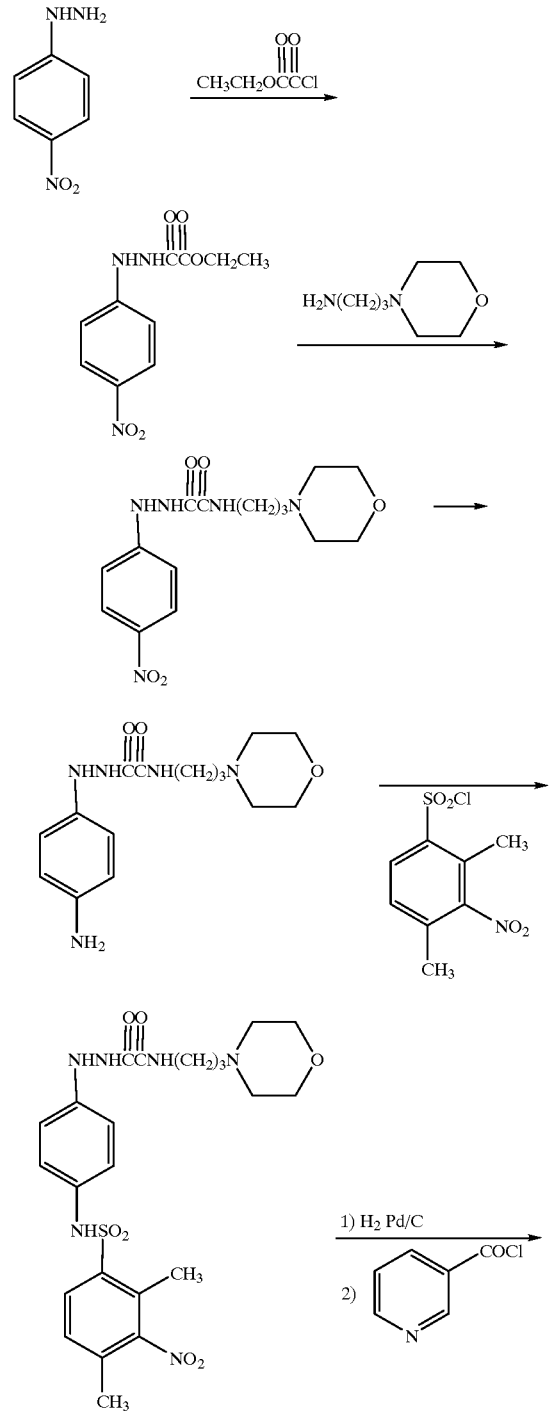

-continued

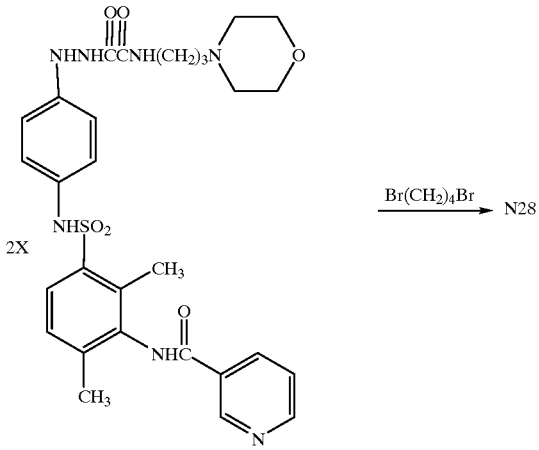

EXAMPLE 4

Preparation of Coatings

The film coatings prepared consisted of a polyethylene terephthalate (ESTAR™) support (with an antihalation pelloid layer on its rear surface) on which was coated a gel underlayer, an emulsion layer and a protective overcoat.

An underlayer illustrative of the present invention consisted of 1 g/m$^2$ gel, 0.3 g/m$^2$ copolymer methacrylate: 2-acrylamido-2-methylpropane sulphonic acid: sodium salt of 2-acetoxyethyl methacrylate (88:5:7 by weight), 96 mg/m$^2$ 3,5-disulphocatechol, 85 mg/m$^2$ hydroquinone, 12 mg/m$^2$ of nucleator N1 and 61 mg/m$^2$ booster compound B 1.

B1

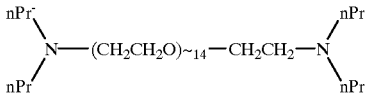

The emulsion layer consisted of 3.3 g Ag/m$^2$ of a 70:30 chlorobromide cubic monodispersed emulsion (0.18 $\mu$m edge length) uniformly doped with ammonium pentachlororhodate at 0.17 mg/Agmol and chemically sensitized with sulphur and gold. The emulsion was spectrally sensitized with 390 mg/Agmol of 1H-benzimidazole-1-propanesulfonic acid, 2-((1,3-diethyltetrahydro-4,6-dioxo-2-thioxo-5(2H)-pyrimidinylidene) ethylidene)-3-ethyl-2,3-dihydro-, sodium salt. Other addenda included were 243 mg/Agmol of 2-mercapto-methyl-5-carboxy-4-hydroxy-6-methyl-1,3,3*a*,7-tetra-azaindene and 23 mg/Agmol 1-(3-acetamidophenyl)-5-mercaptotetrazole. The layer also contained 2.35 g/m$^2$ gel, and 0.7 g/m$^2$ of copolymer methacrylate: 2-acryl-amido-2-methylpropanesulphonic acid: sodium salt of 2-acetoxyethylmethacrylate (88:5:7 by weight).

The overcoat contained 0.5 g/m$^2$ gel with matte beads and surfactants to aid coatability.

Various coatings were made by changing the underlayer formulation as indicated in Table I below, all comparisons being at equimolar levels taking into account the nucleators of the invention which have two hydrazide moieties as providing two equivalents of active hydrazide per mole.

Two comparison monomeric hydrazide nucleators were used. The first of these, C1, is presently used in a commercial product and the second, C2, contains both a hydrazide and nicotinamide moiety:

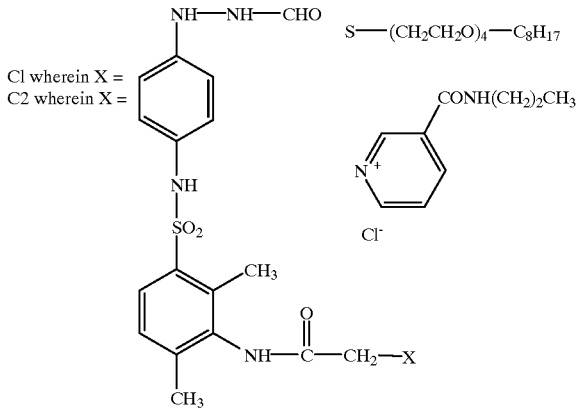

EXAMPLE 5

Evaluation of Coatings (i) Sensitometric data

The coatings were evaluated by exposing through a 0.1 increment step wedge with a $10^{-6}$ sec. flash sensitometer fitted with a P11 filter (which simulates an argon-ion laser exposing source) and then processed in Kodak RA2000 Developer (diluted 1+2) for 30 sec. at 35° C. Comparisons of the sensitometry for the coatings described above were made as shown in Table I.

TABLE I

Sensitometric data

| Nucl | Conc $\mu$/m$^2$ | Booster | $D_{min}$ | PrD | Sp0.6 | EC | USC | C. Spr. |
|---|---|---|---|---|---|---|---|---|
| None | | None | 0.013 | 4.46 | 106 | 8.15 | 10.55 | 0.00 |
| C1 | 21 | None | 0.012 | 4.75 | 108 | 8.50 | 10.71 | 0.04 |
| C2 | 21 | None | 0.012 | 4.95 | 107 | 8.79 | 11.4 | 0.02 |
| N1 | 10.5 | None | 0.013 | 5.37 | 111 | 11.03 | 19.58 | 0.04 |
| N2 | 10.5 | None | 0.012 | 5.15 | 110 | 12.41 | 16.55 | 0.06 |
| N3 | 10.5 | None | 0.012 | 4.95 | 107 | 8.61 | 12.06 | 0.01 |
| C1 | 21 | Yes | 0.012 | 5.43 | 132 | 20.13 | 33.38 | 0.72 |
| C2 | 21 | Yes | 0.013 | 4.95 | 112 | 10.44 | 11.01 | 0.05 |
| N1 | 10.5 | Yes | 0.012 | 5.53 | 115 | 15.92 | 21.70 | 0.04 |
| N2 | 10.5 | Yes | 0.013 | 5.34 | 119 | 17.61 | 34.66 | 0.21 |
| N3 | 10.5 | Yes | 0.013 | 5.09 | 110 | 9.12 | 13.22 | 0.01 |

In Table I the following abbreviations are used:
$D_{min}$ - minimum density
Sp0.6 - toe speed, measured as the relative logE exposure required to produce a density of 0.6 above $D_{min}$.
PrD - practical density, measured as the density achieved at an exposure 0.4 logE units higher than the Sp0.6 value
USC - upper scale contrast, measured as the gradient between density points 2.5 and 4.0 above $D_{min}$
EC - effective contrast, measured as the gradient between density points 0.1 and 2.5 above $D_{min}$
Spread - chemical spread, measured as the rate of increase in line width ($\mu$/s) produced when development time is increased from 20 sec. to 50 sec. at 35° C.

It will be seen from Table I that in those coatings without booster significant increases in practical density were observed for the inventive compounds compared to the comparison compounds, as well as generally higher speeds and upper scale contrast. In the presence of booster, the same improvements were seen for the inventive compounds particularly in the upper or shoulder region of the DlogE curve, indicating more efficient nucleation.

In particular it will be noted that C1 and C2 without a booster and C2 with a booster showed inefficient nucleation, having an upper scale contrast of less than 12. Although C1 with booster showed good nucleation it will be observed that the chemical spread was at a high level. In contrast the nucleators of the invention with and without booster showed efficient nucleation and low chemical spread.

(ii) Process latitude evaluation

The coatings tabulated above were also evaluated for process latitude to development time and pH. The results are shown in Table II for coatings having an upper scale contrast above 12 from Example 5 (i), ensuring that coatings having good nucleation activity were compared since it is for such coatings that process latitude can be a problem.

TABLE II

| Nucl | Conc $\mu/m^2$ | Booster | Sp0.6 change 20 s–40 s | 50% dot change pH 10.2–10.7 | Sp0.6 change pH 10.2–10.7 |
|---|---|---|---|---|---|
| N1 | 10.5 | None | 5 | 1.2 | 6 |
| N2 | 10.5 | None | 6 | 1.4 | 5 |
| N3 | 10.5 | None | 2 | 0.5 | 2 |
| C1 | 21 | Yes | 10 | 9.9 | 12 |
| N1 | 10.5 | Yes | 4 | 1.8 | 10 |
| N2 | 10.5 | Yes | 8 | 4.6 | 10 |
| N3 | 10.5 | Yes | 3 | 0.1 | 3 |

The compounds of the invention were found to be less susceptible to pH change and to development time than was the comparison compound. Thus the toe speed (Sp 0.6) change for both time and pH variation for the nucleators of the invention was lower and the 50% dot change was significantly less and by a factor of at least 2 as compared with the comparison compound.

(iii) Robustness to nucleator level

Several coatings were examined at different levels of nucleator to ascertain the robustness of the system to nucleator level, again comparing efficient nucleators wherein process variation can occur.

TABLE III

| Nucl | Conc $\mu/m^2$ | Booster | $D_{min}$ | PrD | Sp0.6 | EC | USC | C. Spr. |
|---|---|---|---|---|---|---|---|---|
| C1 | 7.2 | Yes | 0.015 | 5.89 | 126 | 22.83 | 40.76 | 0.477 |
| C1 | 10.5 | Yes | 0.013 | 5.64 | 130 | 17.46 | 30.78 | 0.612 |
| C1 | 21 | Yes | 0.012 | 5.43 | 132 | 20.13 | 33.38 | 0.720 |
| N1 | 5.3 | Yes | 0.015 | 5.81 | 114 | 9.53 | 16.93 | 0.000 |
| N1 | 10.5 | Yes | 0.016 | 5.78 | 115 | 12.59 | 20.61 | 0.024 |
| N1 | 15.7 | Yes | 0.015 | 5.69 | 117 | 14.06 | 26.63 | 0.012 |
| N2 | 5.3 | Yes | 0.013 | 5.63 | 114 | 13.99 | 18.97 | 0.097 |
| N2 | 10.5 | Yes | 0.013 | 5.34 | 119 | 17.61 | 34.66 | 0.210 |

It will be noticed that the inventive nucleators showed generally better robustness to concentration variation. In particular the chemical spread for each nucleator of the invention was at a significantly lower level than that of the comparison nucleator.

EXAMPLE 6

Film designs taking advantage of the unique properties of nucleated systems have been described in EP-A-0 681 208 and EP-A-0 682 288 wherein it is described that lower coated dye levels can be used to produce reduced dye stain. The nucleator N1 of this invention was also tested for compatibility with this type of system.

Preparation of coating

A film coating was prepared consisting of a polyethylene terephthalate (ESTAR™) support (with an antihalation pelloid layer on its rear surface) on which was coated an emulsion layer, a gel interlayer, and a protective overcoat.

The emulsion layer consisted of a blend of two emulsions: one dyed and coated at 1.0 g Ag/$m^2$ and the other undyed and coated at 1.4 g Ag/$m^2$.

The dyed emulsion was a cubic monodispersed 70:30 chlorobromide (0.18 $\mu$m edge length) uniformly doped with ammonium pentachlororhodate at 0.17 mg/Agmol and chemically sensitized with sulphur and gold. The emulsion was spectrally sensitized with 265 mg/Agmol of naphtho(1,2-d)thiazolium, 1-(3-sulfopropyl)-2-(2-((1-(3-sulfopropyl) naphtho(1,2-d)thiazol-2(1H)ylidene)-methyl)-1-buteny)$^-$, inner salt, compound with N,N-diethylethanamine (1:1) and 400 mg/Agmol benzothiazolium, 5-chloro-2-(2-((5-chloro-3-(3-sulfopropyl)-2(3H)-benzothiazolylidene)methyl)-1-butenyl)-3-(3-sulfo-propyl)$^-$, inner salt, compound with N,N-di-ethyl-ethanamine (1:1). The other addenda were as described in Example 4.

The undyed emulsion was a cubic monodispersed 50:50 chlorobromide emulsion (0.10 $\mu$m edge length) uniformly doped with ammonium pentachlororhodate at 0.17 mg/Agmol and chemically sensitized with sulphur and gold. No sensitizing dye was added but antifoggants were used as in Example 4, their addition rates being adjusted for the increased surface area of the emulsion. The interlayer consisted of 0.65 g/$m^2$ of gel and 0.195 g/$m^2$ of copolymer methacrylate: 2-acrylamido-2-methyl-propanesulphonic acid: sodium salt of 2-acetoxy-ethyl methacrylate (88:5:7 by weight), 12 mg/$m^2$ nucleator N1 and 60 mg/$m^2$ booster B1.

The overcoat was as described for Example 4 except that 1.0 g/$m^2$ gel was used.

As before a comparison coating was made as shown below in Table IV:

TABLE IV

| Nucleator | Level (mol/$m^2$) | Booster | |
|---|---|---|---|
| C1 | $7.9 \times 10^{-6}$ | B1 | comparison |
| N1 | $10.5 \times 10^{-6}$ | B1 | invention |

EXAMPLE 7

(i) Sensitometric data

The coatings were evaluated by exposing through a 0.1 increment step wedge with a $10^{-6}$ sec. flash sensitometer fitted with a W29 filter and then processed in Kodak RA2000 Developer (diluted 1+2) for 20 sec. at 35° C. The results are shown in Table V.

TABLE V

| Nucl | PrD | Sp0.6 | EC | USC | Toe | C. Spr. | P. Fog |
|---|---|---|---|---|---|---|---|
| C1 | 4.68 | 1.68 | 12.75 | 11.37 | 6.02 | 0.899 | 7 |
| N1 | 4.49 | 1.63 | 15.04 | 11.41 | 8.30 | 0.198 | 1 |

wherein

P.Fog indicates the relative number of pepper fog spots in an unexposed region of the processed film, 1 being the best, 2 and 3 being acceptable and 4–10 being unacceptable and toe is measured as the gradient between density points 0.1 and 0.6 above $D_{min}$.

Comparisons of the sensitometry show the significantly improved performance of the nucleator N1 compared to comparison C1, especially with regard to effective contrast, chemical spread and pepper fog. It should be noted that the booster was included in both coatings since in the absence of booster no pepper fog is observed and no comparison of this feature can thus be made.

(ii) Process latitude evaluation

Variations in development time were done to compare the robustness of the two nucleators C1 and N1 and the results are shown in Table VI.

TABLE VI

| | Sp0.4 for Developer times shown: | | | | |
|---|---|---|---|---|---|
| Coating | 20 s | 25 s | 30 s | 40 s | 50 s |
| C1 | 0.95 | 1.06 | 1.15 | 1.27 | 1.36 |
| N1 | 0.83 | 0.96 | 1.05 | 1.10 | 1.13 |

It will be seen from the above that Nucleator N1 is more robust than C1 at all development times.

The invention has been described in detail with particular reference to certain preferred embodiments thereof, but it will be understood that variations and modifications can be effected within the spirit and scope of the invention.

We claim:

1. A process of forming a photographic image having ultrahigh contrast which comprises imagewise exposing a photographic material comprising a support bearing a silver halide emulsion layer and processing it with an alkaline developer solution wherein it is developed in the presence of a nucleating agent which is a dimeric molecule comprising two monomers linked by a linking group, each monomer of which (a) may be the same or different and (b) comprises an acylhydrazide moiety and a nicotinamide moiety in combination.

2. The process claimed in claim 1 wherein said nucleating agent has one of the formulae:

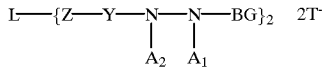

or

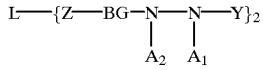

wherein each monomer linked by linking group L is the same or different;

Z is a nicotinamide residue;

Y is a substituted aryl or heterocyclic ring;

one of $A_1$ and $A_2$ is a hydrogen atom and the other is a hydrogen atom, an acyl group or an alkyl- or arylsulfonyl group, any of which may be substituted;

BG is a blocking group; and

L is a linking group and $T^-$ is an anionic counterion.

3. The process claimed in claim 1 wherein said nucleating agent has one of the formulae:

(G1)

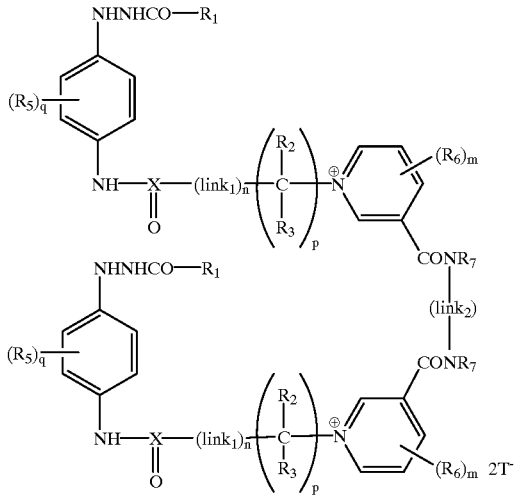

(G2)

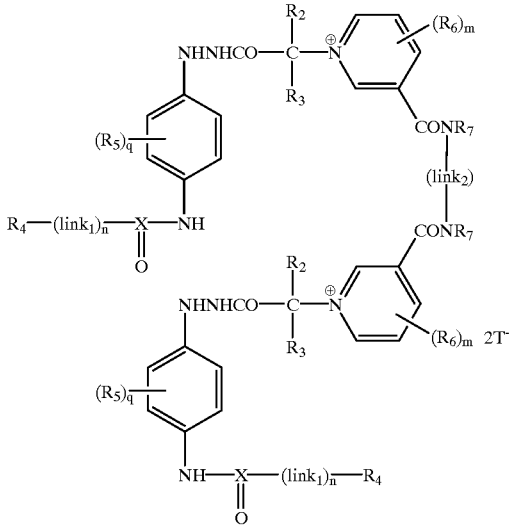

(G3)

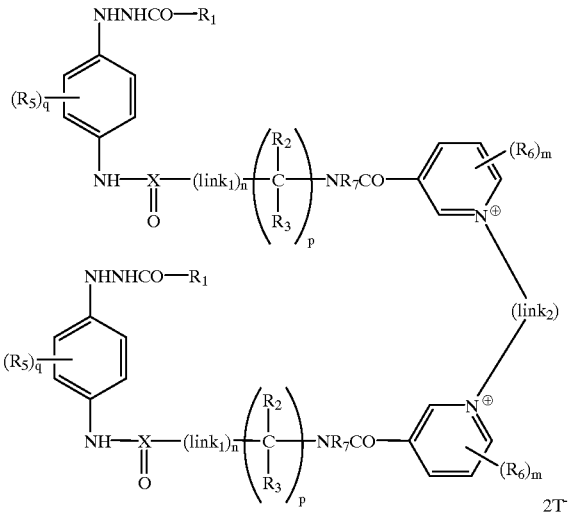

wherein each $R_1CO$ comprises a blocking group in which each $R_1$ is the same or different and is selected from a hydrogen atom, and an unsubstituted or substituted alkyl, aryl, alkoxy- or aryloxy-carbonyl and alkyl- or aryl-aminocarbonyl group; or each $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

each $R_2$, $R_3$ and $R_7$ are the same or different and are selected from hydrogen and an unsubstituted or substituted alkyl or aryl group and p is 0 or 1;

each $R_4$, $R_5$ and $R_6$ are the same or different and may individually or together be selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure;

each q and m are the same or different and q is an integer from 0 to 4 and m is an integer from 0 to 3;

each X is the same or different and is selected from C, S=O and C—NH;

each ($link_1$) is the same or different and is selected from an unsubstituted or substituted alkylene, polyalkylene, aryl, arylaminocarbonyl or heterocyclyl group and each n is 0 or 1; and each ($link_2$) is a linking group selected from an unsubstituted or substituted polyalkylene, polyalkylene oxide, polyalkylene containing one or more heteroatoms selected from nitrogen, oxygen and sulphur, separated from each other by alkylene groups, or an unsubstituted or substituted polyalkylene in which the alkylene groups are separated by an unsubstituted or substituted aryl or heterocyclic ring and $T^-$ is an anionic counterion.

4. The process claimed in claim 1 wherein the photographic material is developed in the presence of a booster compound.

5. The process claimed in claim 4 wherein said booster compound is an amine booster.

6. The process claimed in claim 5 wherein said amine booster is

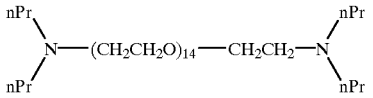

* * * * *